US006871601B2

(12) United States Patent
Stinson

(10) Patent No.: US 6,871,601 B2
(45) Date of Patent: Mar. 29, 2005

(54) DEPOSITORY CABINET

(76) Inventor: Martin J. Stinson, 1955 Nutmeg St., Escondido, CA (US) 92056

( * ) Notice: Subject to any disclaimer, the term of this patent is extended or adjusted under 35 U.S.C. 154(b) by 50 days.

(21) Appl. No.: 10/057,281

(22) Filed: Jan. 25, 2002

(65) Prior Publication Data

US 2003/0140826 A1 Jul. 31, 2003

(51) Int. Cl.[7] ..... G07G 5/00

(52) U.S. Cl. ..... 109/24.1; 109/19; 109/46; 109/49; 109/55

(58) Field of Search ..... 109/19, 24.1, 45–49, 109/55–57, 66, 73, 53, 54; 232/47; 312/211, 212

(56) References Cited

U.S. PATENT DOCUMENTS 3,784,090 A * 1/1974 Markham ..... 232/44
4,063,520 A * 12/1977 Parsons ..... 109/66
4,351,247 A * 9/1982 Clark ..... 109/19
5,137,212 A * 8/1992 Fiterman et al. ..... 232/43.2
5,284,101 A * 2/1994 Oder et al. ..... 109/46
5,427,036 A * 6/1995 Fee et al. ..... 109/46
5,732,878 A * 3/1998 Schroder et al. ..... 232/1 D
6,298,699 B1 * 10/2001 Gartner et al. ..... 70/278.1
6,561,339 B1 * 5/2003 Olson et al. ..... 198/349

* cited by examiner

*Primary Examiner*—John B. Walsh
(74) *Attorney, Agent, or Firm*—Murphey & Murphey, A.P.C.

(57) ABSTRACT

A low profile depository cabinet-safe combination including a safe forming a hollow safe interior therein accessible through a lockable door, a depository cabinet set atop and locked to the safe, forming an enclosed cabinet interior accessible through a pivotally mounted lockable door by inputting an unlocking combination therein, an opening formed in the safe and an opening formed in the cabinet to place the respective interiors thereof in vertical communication with each other, deposit handling means in the depository cabinet including a deposit plate moveable from inside the cabinet interior, with the cabinet door, to outside the cabinet when the cabinet door is fully opened, on which to place a deposit and a deposit actuator for moving with the cabinet door to move the deposit plate and the deposit placed upon it from outside the cabinet into the cabinet interior, as the door is being closed, and off the deposit plate, over the communications opening, to allow the deposit to fall down into the safe interior and a snap lock for preventing the cabinet door from being reopened until another unlocking combination is inputted to unlock the cabinet front door.

35 Claims, 10 Drawing Sheets

DEPOSITORY CABINET

BACKGROUND OF THE INVENTION

1. Field of the Invention

This invention pertains to the field of safes. More particularly, the invention pertains to a depository cabinet, for use as a lockable deposit chamber where numerous deposits may be irretrievably made for either dropping down into a main safe located therebelow in the same room as the cabinet or dropping down into a receptacle or a main safe located in another room. When used with a main safe located in the same room as the cabinet, the combination of upper depository cabinet and lower main safe can be made in such a low profile that it can be easily positioned under a desk or other such piece of furniture to provide the requisite safe features without occupying otherwise valuable floor space.

2. Description of the Prior Art

Many businesses are "area specific" meaning that their profitablility depends upon maximizing business areas and minimizing administrative areas. For instance, in a fast food franchise, every square foot of usable work space represents a part of a potential table or eating area or storage for supplies, and thus profit, while every square foot of administrative (office) space represents lost work space and a loss of potential profit. Thus, customer work and server space are maximized while administrative space is minimized.

In addition, there are instances where adjacent rooms are established for the purpose of having money counted and handled in one room but irretrievably passed from the "counting" or "handling" room, through the wall dividing the rooms, to the other, adjacent room where the money may be stored, packaged, paid out to third parties, and the like. One such set of adjacent rooms would be located in a gambling casino where depository boxes from gambling tables would be brought, opened, and the money removed and counted. The money would then be irretrievably deposited in a wall-mounted, depository cabinet to pass into a receptacle or safe located in the adjacent room, on the opposite side of the wall, where the money would be bundled and packaged for redistribution to other person through access windows.

In addition, many businesses are run in shifts using managers to supervise workers and to handle sales proceeds (or gambling proceeds) from their respective shifts. At the end of each shift, a manager must deposit the proceeds in a safe to be held securely therein for a period of time pending removal by the business owner after a day or a plurality of shifts. This situation requires separate deposits to be made in the upper deposit cabinet to drop down into a lower safe pending later removal of the accumulated deposits therefrom.

It is not unheard of that unscrupulous employees will attempt to extract monies deposited in the upper deposit cabinet or the lower safe before pickup by the owner. This criminal activity usually involves sliding a wire or a fish hook on a string into the depository cabinet for passage by gravity down into the safe where the deposits have accumulated, and attempting to "fish" out the paper money, or the deposit bags themselves. Once removed, the guilty employee blames the previous manager for not making the deposit or not placing the reported sum in the envelope when the initial deposit was made.

The prior art has developed, and currently markets, depository safes that accept paper or coins or one or more envelopes of "deposits" which drop by gravity down into a lower safe; however, these devices are merely safes with a non-lockable, upper entryway that does not allow for moving the deposit anywhere but downward into a lower safe. Generally, the prior art depository safe comprises a lower main safe body having a first hollow safe interior accessible through a first lockable door that is only openable by the business owner. An upper depository cabinet is mounted in fixed position on top of the lower main safe body to allow access to the lower main safe body through an unlocked top-mounted or front-mounted door that is accessible to the managers (or anyone else) of the business.

The prior art uses four types of depository techniques in the upper deposit cabinet. The first is a V-shaped hopper having a front mounted handle, pivotable at the apex of the hopper so that when the handle is pulled outward from the top of the cabinet, the hopper pivots forward to expose the interior of the hopper and to accept the deposit therein. When the handle is released or pushed backward, the hopper rotates inward of the cabinet and allows the deposit to fall off the rear hopper wall down through the interior passageway between the cabinet and the lower safe into the bottom hollow safe interior. The second type of deposit cabinet is a pull-out drop drawer having a downwardly pivotable drawer floor, usually hinged from the front, but sometimes the rear, of the drawer just inside the drawer handle. When the drawer is pulled out from the deposit cabinet, the drawer interior is exposed to make the deposit therein. When the drawer is pushed closed, the drawer floor pivots downward, inside the deposit cabinet, allowing the deposit to slide off the drawer floor, downward into the hollow safe interior in the lower safe body. The third type has a rotary hopper in the deposit cabinet. An exposed handle is used to rotate the hopper such that it opens through a hole in the top of the cabinet. After the deposit is made in the hopper, the handle is twisted to rotate the hopper and move the open hole in the hopper to align with a bottom hole in the deposit cabinet, allowing the deposit to drop out of the hopper and down into the safe interior. The fourth type is merely a horizontal slot formed in the top of the cabinet. This type of safe accepts only thin envelopes of deposits, is very easily pilfered and, for these reasons, is not readily accepted in the industry.

Each of these prior art depository cabinets share common problems which, currently, have not been answered and which continue to plague the industry. The first problem is that each cabinet is not lockable and requires the deposit to be made inward through the top or top-front of the deposit cabinet. This causes two problems: First, the entire combination of cabinet and safe is easy to pilfer. secondly, the combination is too high and must occupy its own space in the small, cramped manager's office. The floor space required by these prior art devices removes floor space that could otherwise be used to either expand the customer service area or the office space for other uses. The second problem is that each cabinet can only be accessed through the top or top-front thereof. This requires space over the top of the cabinet to be maintained free and clear of other furniture, posting boards, shelving, and the like and represents a further loss of otherwise usable space.

In addition, there is the problem with "fishing" extraction of deposits from the lower safe body. Presently, virtually all prior art deposit cabinets are equipped with "anti-fish" baffles that comprise special plates, walls, dividers, etc., placed at various locations inside the deposit cabinet and in the passageway leading from the upper deposit cabinet down into the safe. While these baffles are somewhat protective of the contents of the deposits already made in the cabinet, criminal ingenuity is constantly at work to overcome these safety measures and, at times, is successful. It is a never-ending chore to develop new anti-fish baffles to stay one step ahead of the thieves.

SUMMARY OF THE INVENTION

This invention is, in one embodiment, an under-table, upper depository cabinet with some major exceptions, such as being lockable and having a low profile, enabling the cabinet to be placed under an existing table or desk to save valuable floor space. In another embodiment, the invention is a wall-mounted, irretrievable, depository cabinet for accepting a deposit in one room and transferring the deposit to another, adjacent room. Further, the invention embodies a novel upper deposit cabinet having a door that opens from the front instead of from the top. Opening from the front means that space above the cabinet can be used for other reasons, such as a place upon which to set other objects, or a place upon which other cabinets or furniture can be placed. The deposit cabinet contains a unique deposit plate that opens with the door to allow placement of loose currency or a "deposit" pouch thereon. A unique deposit actuator is provided that is also arranged to open with the cabinet door and move outboard of the deposit plate when the door is opened. When the deposit cabinet door is closed, both the deposit plate and the deposit actuator move inward with the door. The deposit cabinet includes a rake that passes closely over the deposit plate to force the deposit off the plate and allow it to free-fall by gravity down into the lower safe interior. The utilization of the deposit actuator in conjunction with the deposit plate is a unique design and one that provides anti-fish properties not heretofore possible in existing prior art cabinets. Further, the unique design of the doors in the cabinet prevents access to the interior of the cabinet or to the lower safe, even if the cabinet door hinges are severed in an intent to gain access to the interior of the cabinet.

When used in conjunction with a pair of adjacent rooms, the inventive cabinet may be wall-mounted having its openable, depository door on the wall in one room and the body of the cabinet, including the opening in the cabinet floor, in the adjacent room so that deposits made through the cabinet door from one room drop down into the interior of the adjacent room to be captured by a lower-mounted safe or a receptacle.

Accordingly, this invention is a unique, lockable, depository cabinet that includes, in one embodiment, a lower safe to form a combination that is easily positioned under a desk or table, and, in another embodiment, is wall-mountable to allow deposits made in one room to be transferred into another room. In the first embodiment, the lower safe is defined by a bottom wall, contiguous upstanding side walls, a top wall, and a front wall, forming a first hollow safe interior accessible through a first lockable front door mounted over an opening formed in the front wall and pivotally mounted for swinging open and closed on a first hinge. The upper deposit cabinet of this invention is provided in fixed position on top of the lower main safe body, the upper cabinet defined by a bottom wall, contiguous upstanding side walls, a top wall, and a front wall, forming a hollow interior accessible through a second lockable front door mounted over an opening formed in the front wall and pivotally mounted for swinging open and closed on a second hinge. The interior of the deposit cabinet is in communication with the lower main safe body interior through mutual openings formed in the bottom wall of the deposit cabinet and the top wall of the lower main safe. Thus, the interior of the lower main safe is accessible not only through the main safe door, but also through a second lockable front door pivotally mounted above the first lockable front door for swinging open and closed at a level not above the deposit cabinet. A horizontally moveable deposit plate in the deposit cabinet is provided for receiving a deposit thereon, when the cabinet door is opened, and for moving the deposit into the hollow cabinet interior when the cabinet door is closed, so that it will drop, by gravity, from the hollow cabinet interior, irretrievably down into the lower safe interior.

The safe door includes a lock, such as a combination lock, to secure the front door. The cabinet front door preferably includes an electric push button lock having a digital readout and further includes a plurality of individual numerical combinations that will each unlock the cabinet front door, and a computer memory unit to record information as to the date and time the door was opened. This allows each manager to have his or her own code and provides an "audit trail" to the business owner to determine who, and when, a deposit was made and is an aid in tracing thievery. Another feature making this invention popular in the industry is the plurality of photoelectric cells or the like arranged to direct their beams across the floor of the deposit cabinet into receptors where the beams will be interrupted when a deposit falls from the interior of the cabinet downward into the lower safe interior. This is further evidence for use in establishing an audit trail to track thievery. A still further feature of this invention is that the floor plate is formed with an uneven surface, such as sinusoidal, and the rake includes an edge having a similarly formed shape for following closely on top of the floor plate. This feature allows the deposit of free bills, checks and coins on the deposit plate and insures that the rake will scrape these bills, checks and coins off the deposit plate and allow them to drop down into the lower safe body. As earlier stated, the deposit cabinet of this invention can be wall-mounted so that a deposit made in the cabinet, on one side of the wall, can be easily arranged to drop into a safe or receptacle located on the other side of the wall. The opening in the bottom wall of the cabinet can be located on the opposite side of the wall on which the cabinet is mounted to perform this unique function.

Accordingly, the main object of this invention is a depository cabinet that, when placed in combination with a lower safe, is sufficiently low in profile as to allow it to be placed under an otherwise non-useful surface such as a desk or table. When wall-mounted by itself, the depository cabinet may be used as a means of irretrievably depositing an item in one room and having it passed into another room for capture in a safe or receptacle. Other objects of the invention include a depository cabinet whose door can be arranged directly above the lower safe door to provide only one side of the combination to be exposed for access to both the upper cabinet and the lower safe and to allow this combination to be moved into a cubbyhole such as in the wall of an office or under an existing desk or table. Still further objects of the invention include a depository cabinet having a hollow interior that is accessible from the front of the cabinet, a cabinet that allows deposits of free bills, coins and checks therein not confined to the customary pouch, and insures the items will be moved to the lower safe; a depository cabinet that insures the transfer of deposits made therein to be passed down into the lower safe; and, a cabinet that possesses unique anti-fish capabilities not possible with current prior art devices.

These and other objects of the invention will become more clear when one reads the following specification, taken together with the drawings that are attached hereto. The scope of protection sought by the inventors may be gleaned from a fair reading of the Claims that conclude this specification.

DESCRIPTION OF THE PREFERRED EMBODIMENTS

Figure 1:
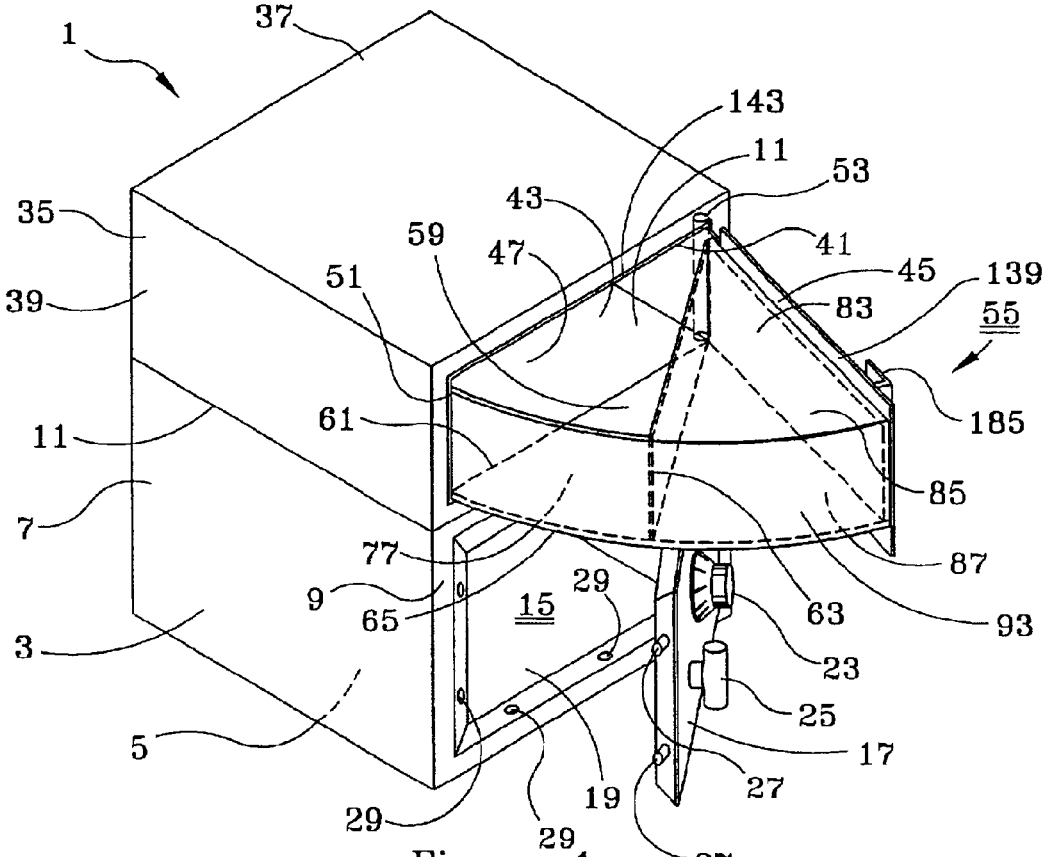
FIG. 1 is a perspective view of one of the preferred embodiments of this invention.

Turning now to the drawings wherein elements are identified with numbers and like elements are identified with like numbers throughout the 23 figures, FIG. 1 shows the overall configuration of this inventive deposit cabinet-safe 1 comprising a lower main safe 3 generally defined by a bottom safe wall 5, three contiguous side walls 7 (only one is shown), a front wall 9 and a top wall 11. Bottom safe wall 5, side walls 7, front wall 9, and top wall 11 are typical safe walls made of metal, such as iron or steel, and are contiguous in that they are joined together along their intersecting side edges and bottom edges, such as by being cast in that configuration or welded together along their respective contacting edges and corners. Thus described is a safe having an interior 15 accessible through a lockable door 17 mounted over an opening 19 formed in front wall 9.

Figure 2:
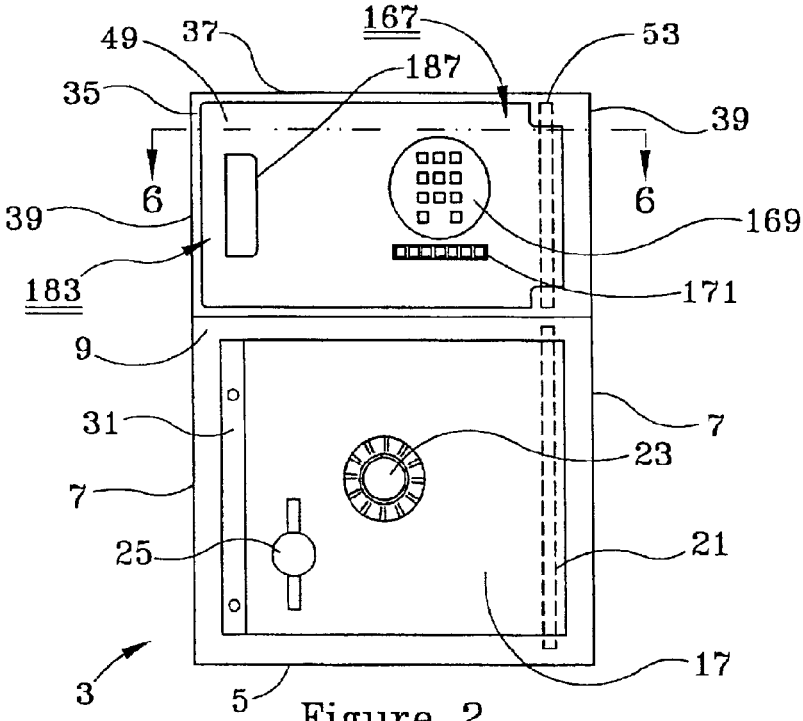
FIG. 2 is a front view of another embodiment of this invention showing the locations of the door hinge pins in dotted outline.
Figure 4:
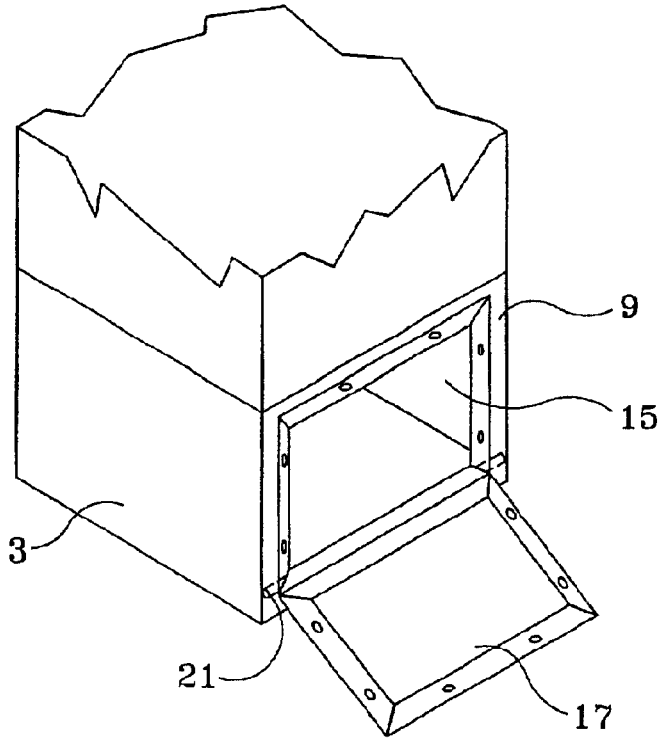
FIG. 4 is a perspective view of the safe showing the lockable door being hinged at the bottom of the opening in the safe front wall.
Figure 5:
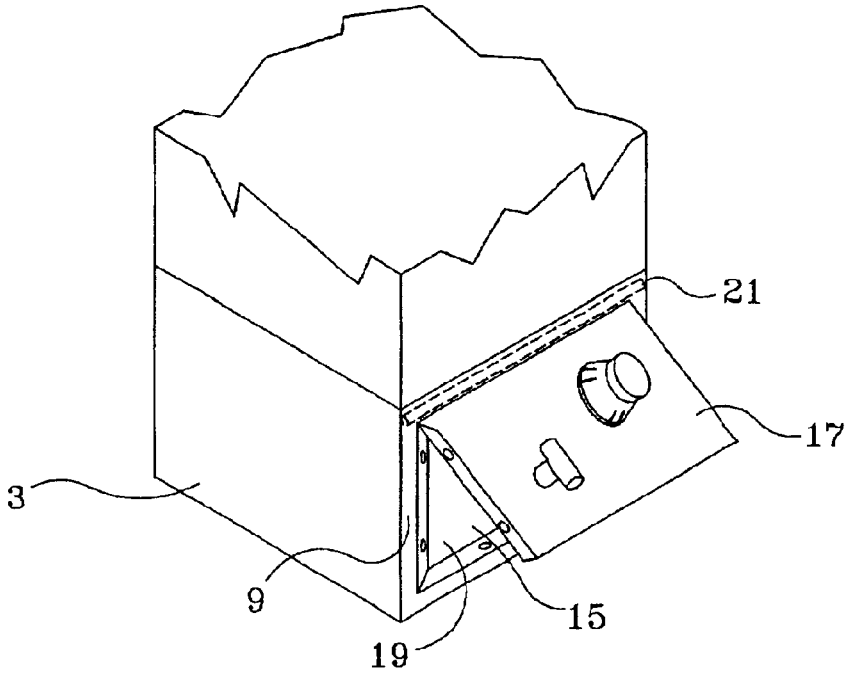
FIG. 5 is a perspective view of the safe showing the lockable door being hinged at the top of the opening in the safe front wall.

Opening 19 may be formed in a number of ways, take on a number of configurations, and still remain within the spirit and scope of this invention. It is preferred that opening 19 be mated with lockable door 17, preferably on a hinge pin 21 (FIG. 2) so that door 17 can easily swing open or closed when unlocked. As shown in FIGS. 1 and 2, a lock, such as a combination safe lock 23, and a lock handle 25 are provided to move locking bolts 27 into and out of locking recesses 29, during locking and unlocking of safe 1. Hinge 21 is preferably a vertically-oriented hinge so that door 17 swings through an arc parallel to the plane of safe bottom wall 5 or in a horizontal plane. Other means to hang door 17 on safe 1 and other directions of movement of door 17, such as downward on a hinge located below opening 19 (FIG. 4) or opening upward on a hinge located above opening 19 (FIG. 5) are also contemplated in this invention.

Figure 7:
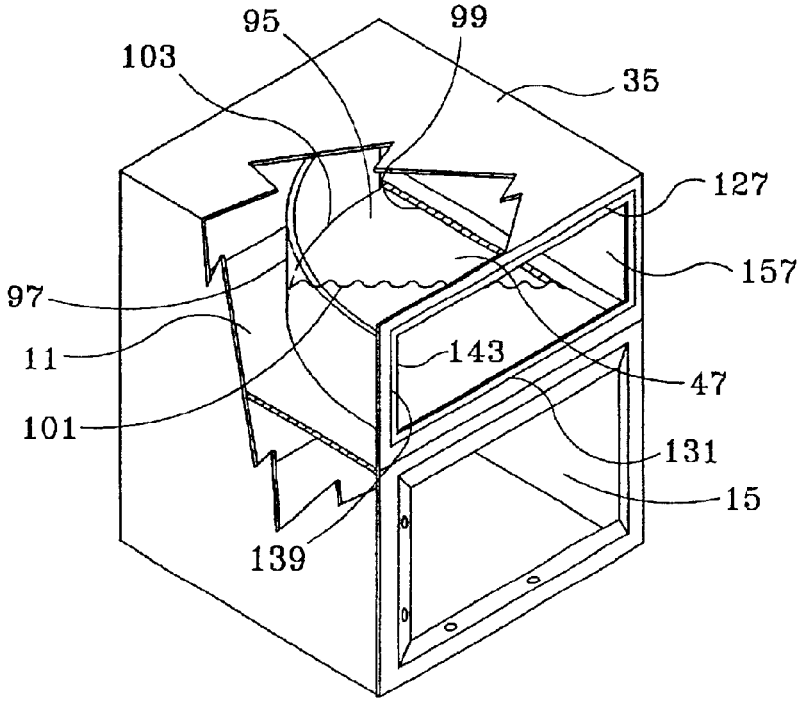
FIG. 7 is a perspective view of the depository cabinet and safe combination shown in FIG. 1 with the doors removed for better viewing and with a section removed from the side walls and top walls of the cabinet and one side wall of the safe to allow viewing of the inside thereof.

As shown in FIGS. 1 and 2, an upper deposit cabinet 35 is provided in a fixed position and locked on top of lower safe 3, down on top of top wall 11. It is preferred that deposit cabinet 35 be comprised of a top cabinet wall 37 and three downwardly descending cabinet side walls 39 extending down toward safe side walls 7 and front wall 9. Other configurations of side walls and front walls, such as a round safe, are fully contemplated herein. The walls are in contiguous orientation, meaning that they are also joined together along their respective intersecting side edges and top edges such as by being cast in that configuration or welded together along contacting edges and corners. Cabinet top wall 37, along with side walls 39, a cabinet front wall 41, and a cabinet bottom wall 42, complete the exterior of cabinet 35 and form a hollow cabinet interior 43 as shown in FIG. 7. Interior 43 is accessible through a lockable cabinet door 45 mounted over an opening 47 formed in front wall 41 as shown in FIG. 1. Cabinet bottom wall 42 forms an opening 48 that mates up with an opening formed in safe top wall 11 as will be more fully explained later.

Figure 8:
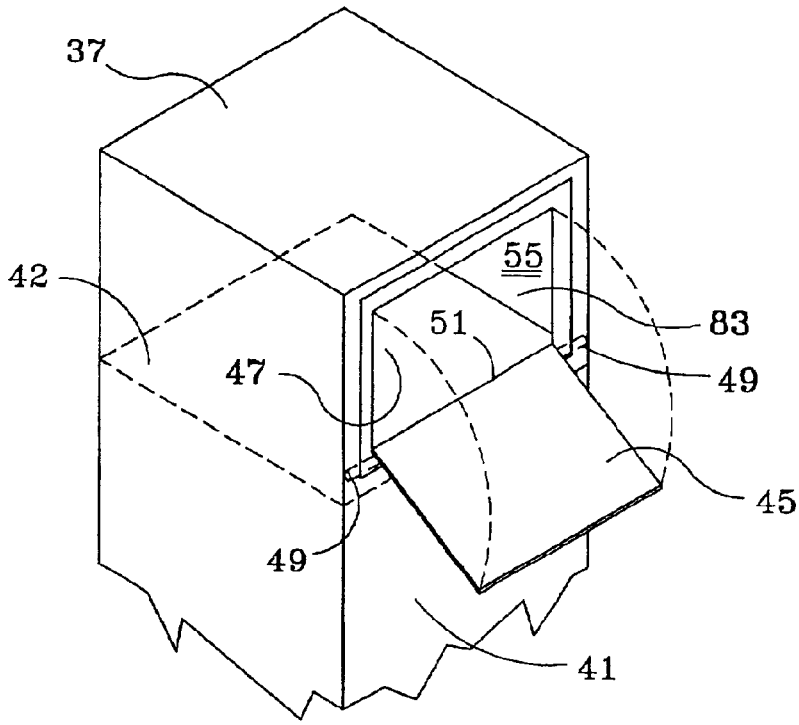
FIG. 8 is a perspective view of the portion of the depository cabinet showing the lockable door being hinged at the bottom of the opening into the cabinet.
Figure 9:
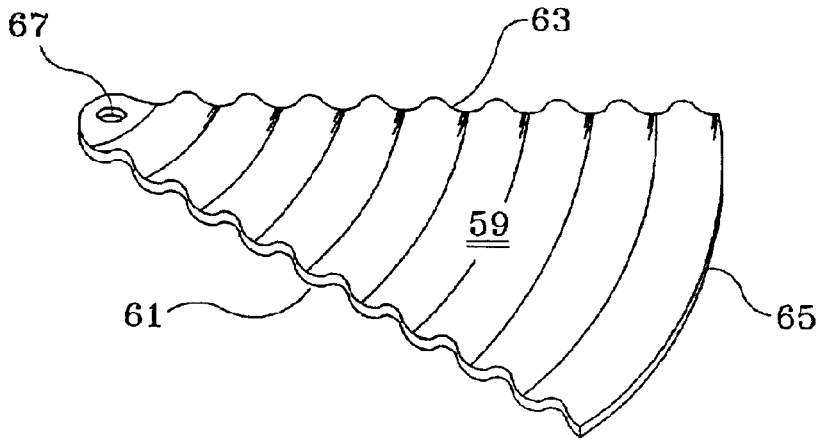
FIG. 9 is a perspective view of the deposit plate having a sinusoidal surface.

Lockable cabinet door 45 may be mounted on cabinet front wall 41 in a variety of ways and still remain within the spirit and scope of this invention. It is required, however, that cabinet door 45 be mounted such that, when it opens, it does not exceed the plane of cabinet top wall 37 and that it provides an opening in from the top of a deposit handling means that will hereinafter be more fully described. For instance, door 45 can be mounted on one or more horizontally oriented hinges 49 located below the bottom edge 51 of opening 47 and swing through an arc as shown in dotted outline in FIG. 8. It is preferred, however, that door 45 be mounted on one or more vertically oriented hinge pins 53 and swung through a horizontal arc as shown in FIGS. 1 and 2.

Figure 10:
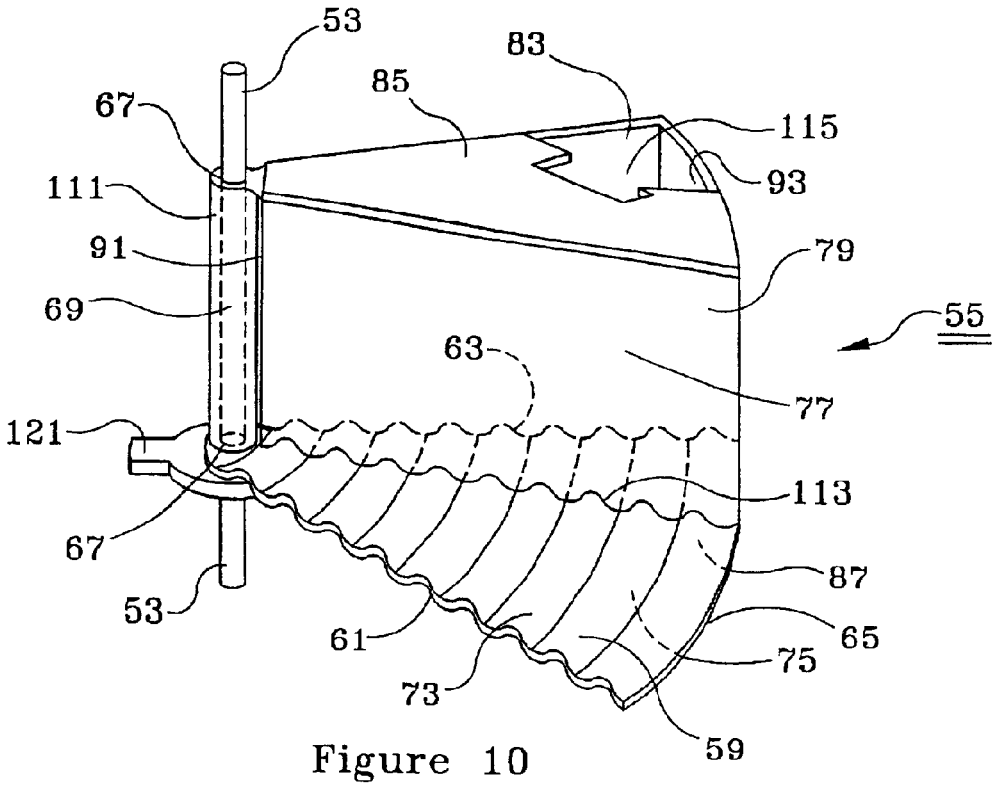
FIG. 10 is a perspective view of the deposit actuator and the deposit plate showing how the plate moves into the interior of the deposit actuator and showing part of the interior of the deposit actuator.
Figure 11:
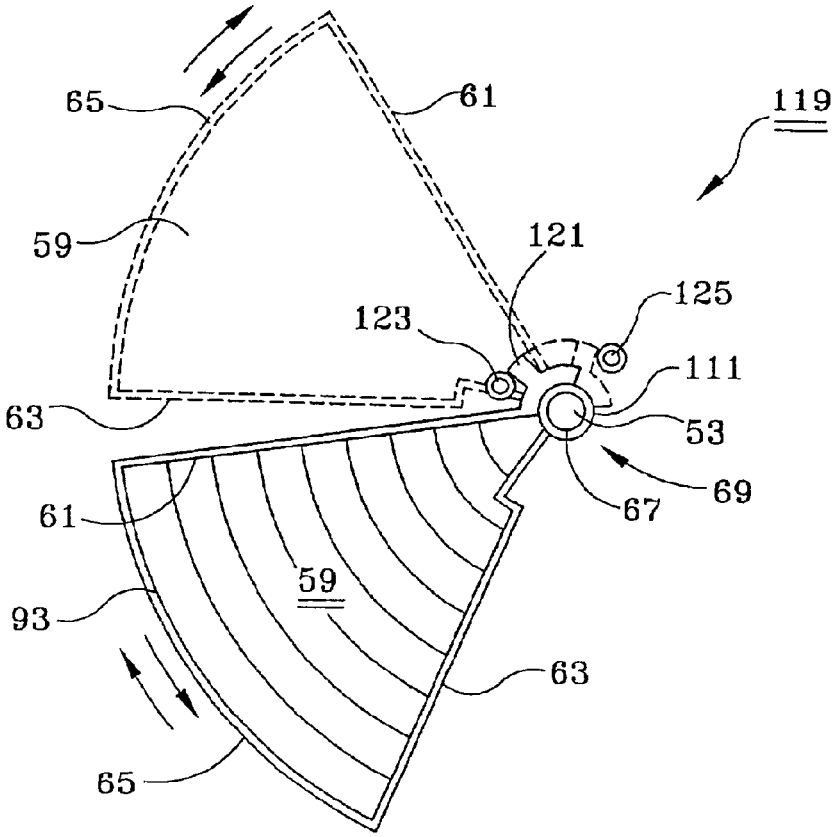
FIG. 11 is a top view of the deposit plate moving from outside the cabinet into the cabinet interior and the door position means that controls the position.

A deposit handling means 55 is located inside deposit cabinet 35 and is shown in FIGS. 1, 6*a*–6*d*, 9, 10 and 11 to comprise a deposit plate 59 that is triangular, and preferably pie-shaped, in overall configuration and is further defined by a front edge 61, a rear edge 63 and an outside edge 65. As shown in FIGS. 10–11, a pivot hole 67 is formed at the junction 69 of the first terminal ends of front edge 61 and rear edge 63. Outside edge 65 lies between the second terminal ends of front edge 61 and rear edge 63 to form a three-sided perimeter. It is preferred, as shown in FIG. 10, that pivot hole 67 house vertically oriented hinge pin 53 that supports deposit plate 59 in pivotal, horizontal attitude. As shown in FIG. 10, deposit plate 59 is further defined by top and bottom plate surfaces 73 and 75 respectively.

As shown in FIG. 10, a deposit actuator 77 is likewise provided and includes a front wall 79 and a rear wall 83, the latter being attached to the inside surface of cabinet door 45. Deposit actuator 77 is three-dimensional and has a top wall 85 and a bottom wall 87 in spaced-apart arrangement, as well as an outside wall 93 as shown in FIG. 1.

Because rear wall 83 is placed against or forms the inner surface of cabinet door 45, deposit actuator 77 is actuated when said door is opened and closed, swinging through a horizontal arc.

Figure 6A:
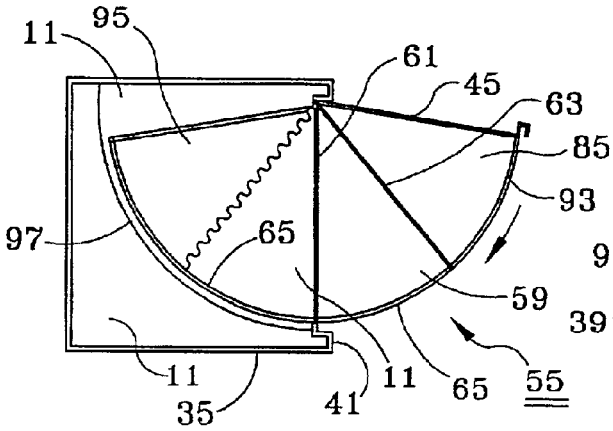
FIGS. 6*a*–6*d* are top views of the deposit handling means, taken along a plane 6—6, as shown in FIG. 2, showing four stages of closing the deposit handling means in the cabinet.
Figure 6B:
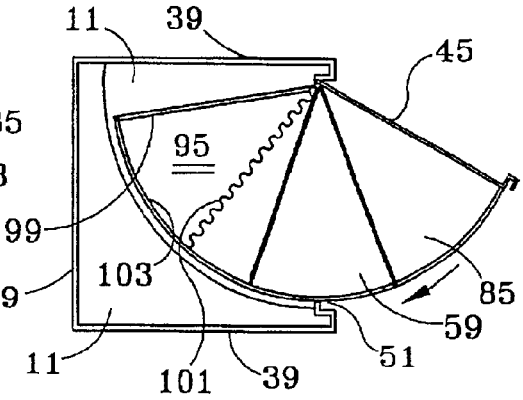
Figure 6C:
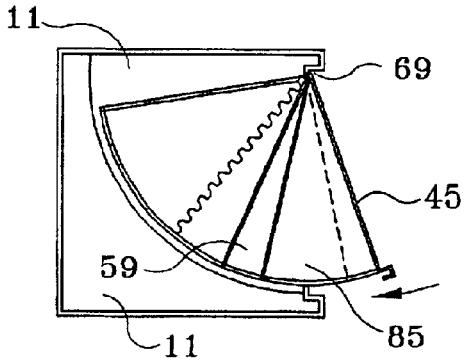
Figure 6D:
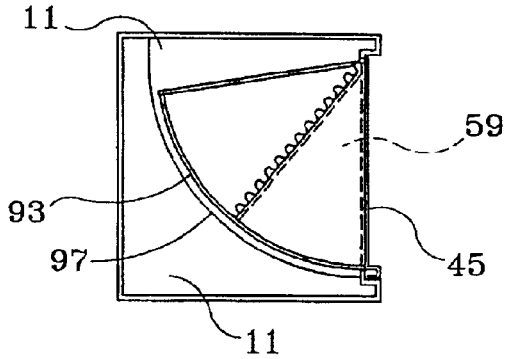

As shown in FIGS. 6*a*, and 7, a curved wall 97 is located inside cabinet 35 and provides a solid barrier inside cabinet 35 spaced very closely to deposit plate outside edge 65 and deposit actuator outside wall 93 to allow very close passage therebetween. As shown in FIG. 7, safe top wall 11 is located tightly against the inside of safe side walls 7, safe front wall 9, and cabinet bottom wall 42 and forms a substantially pie-shaped opening 95 therein bounded by first and second side edges 99 and 101, respectively, and an outer curved edge 103. Opening 95 coincides with cabinet bottom wall opening 48 to provide an unobstructed passageway from cabinet 35 down into safe interior 15 or otherwise in vertical communication with each other. It is preferred that cabinet bottom wall opening 48 be bounded by first and second side edges and an outer curved edge that coincide with edges 99, 101 and 103 of safe top wall opening 95. As shown in FIGS. 10 and 11, sleeve 111 is attached along the joined terminal edges of deposit actuator front wall 79 and rear wall 83 and encircles hinge pin 53.

Figure 12:
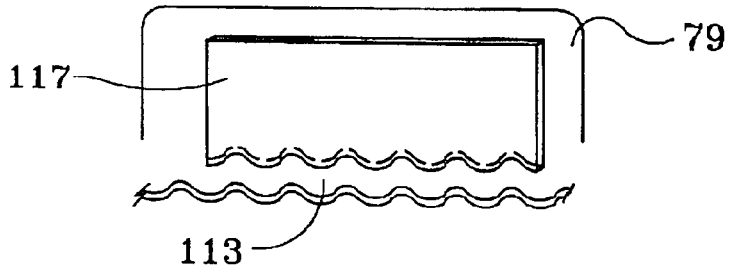
FIG. 12 is a perspective view of a portion of the slot in the front wall of the deposit actuator and the rake that passes over the upper surface of the deposit plate to scrape off the deposit in the interior of the cabinet.

A slot 113 is formed in deposit actuator front wall 79 near bottom wall 87, as shown in FIGS. 10 and 12, for the purpose of allowing deposit plate 59 to pass therethrough and into the hollow interior 115 of deposit actuator 77 as cabinet door 45 is pivoted on hinge pin 53. A rake 117, either added separately as shown in FIG. 12 or merely cut out of deposit actuator front wall 79, is located on front wall 79 adjacent and along slot 113. As shown in FIG. 10, in one preferred embodiment, deposit plate 59 is formed in a sinusoidal design that is concentric about pivot hole 67. Rake 117 is made in the same sinusoidal design and arranged to pass close to deposit plate top surface 73 when deposit plate 59 is passed through slot 113 and into hollow interior 115 so that coins, checks and dollar bills deposited on deposit plate top surface 73 will be scraped off and into opening 95 to fall directly down into safe interior 15. A deposit plate position means 119 is provided to control the position of deposit plate 59 as cabinet door 45 is opened and closed. Means 119 is necessary to place deposit plate 59 inside cabinet interior 43 and inside deposit actuator 77 when cabinet door 45 is closed against cabinet 35. Means 119 is also necessary to place deposit actuator front wall 79 and deposit plate front edge 61 at safe top wall opening front edge 101, and its coincident cabinet bottom wall opening front edge so that anything previously deposited on deposit plate 59, when cabinet door 45 was opened, has been pushed off therefrom to drop down through openings 48 and 95 into safe interior 15.

When cabinet door 45, closed against cabinet front wall 41, is pulled open, deposit actuator 77, inside door 45 with deposit plate 59 inside cabinet interior 45 and inside deposit actuator hollow interior 115, begins to swing or pivot outward along with door 45. Means 119 is shown in FIG. 11 to comprise a position tab 121, attached to deposit plate 59, that rotates with deposit plate 59 between a first stop 123 and a second stop 125. As shown in FIGS. 10 and 11, as door 45 is pulled open, deposit actuator 77 swings with it and begins to rotate out of cabinet interior 43. As tab 121 strikes first stop 123, it causes deposit plate 59 to stop rotating about hinge pin 53 and remain in position as door 45 is swung further open. Deposit actuator 77 continues to swing outward and deposit plate 59 passes outward through slot 113. When door 45 reaches full open, deposit plate 59 is fully exposed, having its front edge adjacent cabinet front wall 41 while deposit actuator 77 is further outboard and has its rear wall adjacent and in contact with door 45. Deposit plate 59 is now ready to accept a deposit.

As shown in FIGS. 6*a* through 6*d*, when cabinet door 45, now fully open, is swung closed, deposit actuator 77, adjacent door 45 with deposit plate 59 between it and cabinet front wall 41, begins to swing or pivot into cabinet interior 43. Position tab 121, attached to deposit plate 59, rotates with deposit plate 59 between a first stop 123 and a second stop 125. As shown in FIG. 11, as door 45 is closed further, deposit actuator 77 swings with it and begins to rotate into cabinet interior 43. Deposit plate 59 also rotates into cabinet interior 43. As plate 59 finally enters cabinet interior 43, tab 121 strikes second stop 125, causing deposit plate 59 to stop rotating about hinge pin 53 and remain in position inside cabinet front wall 41. Deposit actuator 77 continues to swing inward with door 45 and deposit plate 59 begins to pass through slot 113 into deposit actuator 77 as actuator 77 rotates inward into cabinet interior 43. As this occurs, rake 117 pushes the deposit off deposit plate 59 into openings 48 and 95 where it falls, under the influence of gravity, into safe interior 15. When door 45 reaches its full closed position against cabinet front wall 41, deposit plate 59 is fully inside deposit actuator 77.

Figure 13:
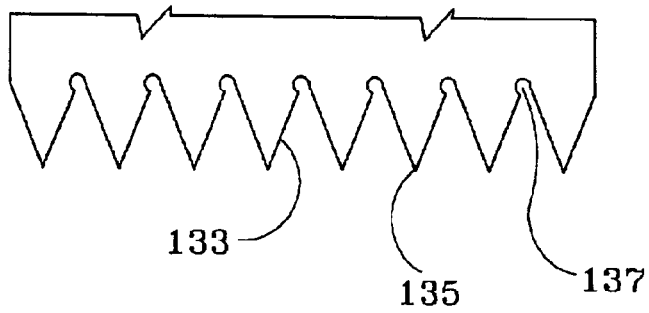
FIG. 13 is an illustrative view of a portion of the anti-fish baffles that are mounted in the interior of the cabinet.
Figure 21:
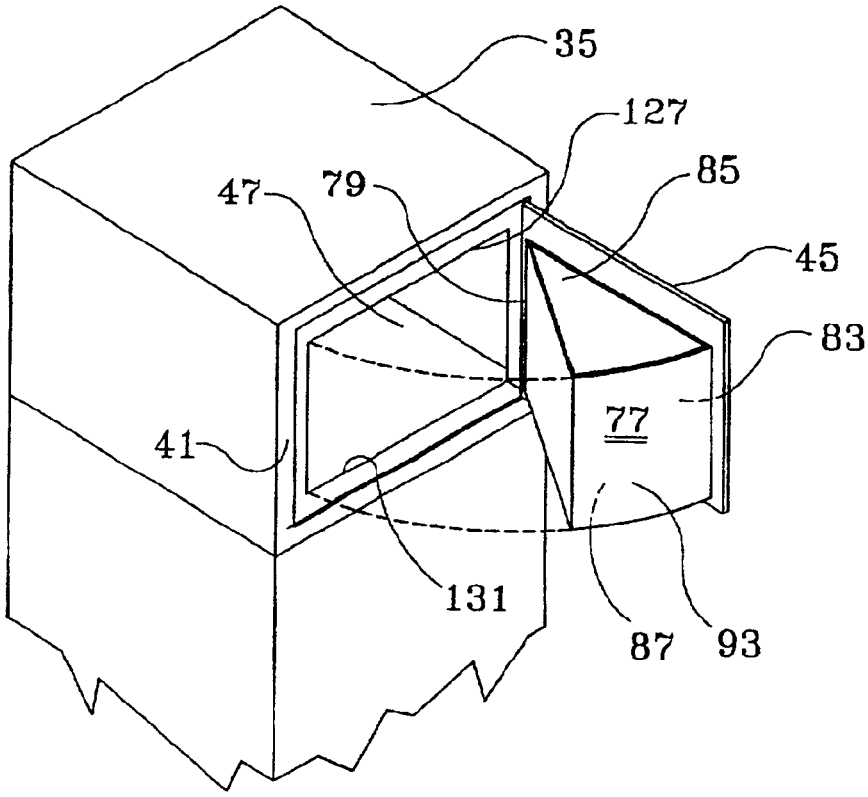
FIG. 21 is an illustrative view of the front door swinging into the cabinet.

As shown in FIG. 21, deposit actuator top wall 85 is preferably made to lie and swing through a dotted line arc set slightly below the top edge 127 of opening 47 over which cabinet door 45 closes when shut against cabinet front wall 41. Similarly, actuator bottom wall 87 is made to lie and swing through the same dotted line arc set slightly above bottom edge 131 of opening 47. In this manner, deposit actuator 77, with it's full front wall 79 and full rear wall 83, completely fills opening 47 when passing therethrough. Curved wall 97, interior of cabinet 35, lies closely adjacent actuator outside wall 93 during the same movement of door 45, inward to cabinet 35, thus providing a full barrier to the entrance of "fish" wires, hooks and strings into cabinet 35 when door 45 is in any position other than fully closed against front wall 41. To further bar entrance against thieves, as shown in FIGS. 7 and 13, side edge 101 of opening 95, and preferably the coinciding side edge of cabinet bottom wall opening 48, have formed thereon a plurality of sharp edges 133, sharp points 135 and sharp-edged openings 137 to catch and hold or sever any wires or strings that someone may attempt to slide under deposit actuator bottom wall 87 or over top wall 85 or around outside wall 93 in an effort to fish a deposit from safe interior 15 or cabinet interior 43.

Figure 14:
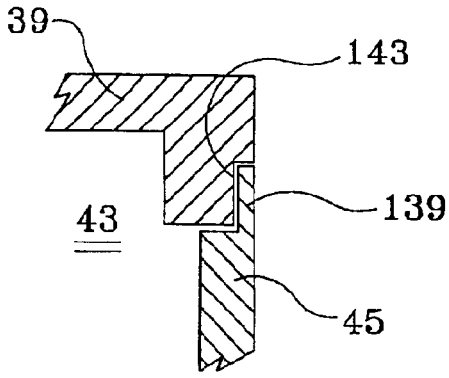
FIG. 14 is a fragmentary sectional view of a portion of the front of the door in the cabinet, showing how the rim and inset of the door and door jamb prevent the insertion of fishing devices in through the cabinet door.

As shown in FIG. 14, cabinet door 45 preferably is formed with an outside rim 139 that fits into an inset 143 formed about opening 47. Rim 139 discourages the practice of slipping or inserting a fish wire in between the edges of opening 47 and deposit actuator 77 as well as giving cabinet 35 a streamlined design. In doing so, door hinge pin 53 is inset from front wall 41.

A common practice of thieves is to sever a safe door hinge pin and remove the door "backward" i.e., pulling the door edge adjacent the severed hinge or hinges outward first without having to deal with the locking mechanism that is usually located on the opposite door edge. This invention discourages such action in two ways. First, the inset of cabinet hinge pin 53 as shown in FIG. 2 means more metal surrounds hinge pin 53 than if it were located outside front wall 41. This means more heat is needed to sever pin 53 thereby requiring the thieves to use bigger, heavier torches and to remain with the safe for a longer period of time.

Figure 15:
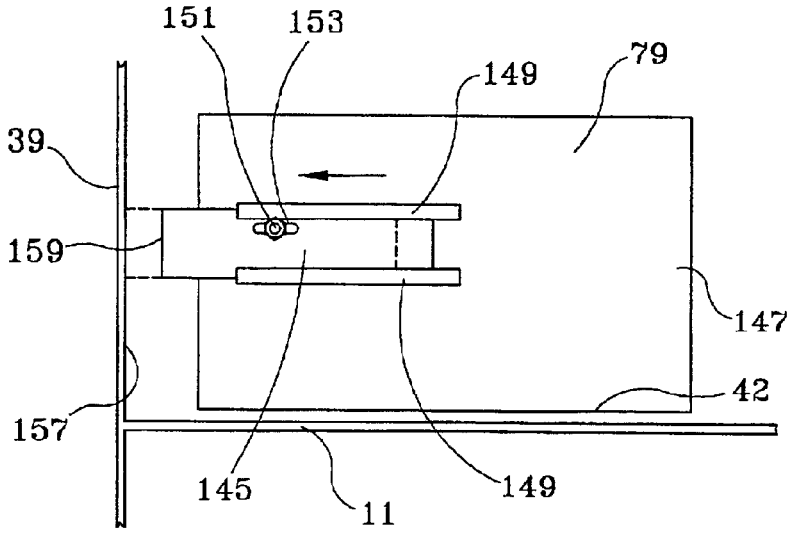
FIG. 15 is a vertical plan view of the locking bar and shows the ability of the bar to be moved into contact or near contact with the inside surface of a nearby cabinet side wall to deter removal of the door should the hinge pins be severed.
Figure 16:
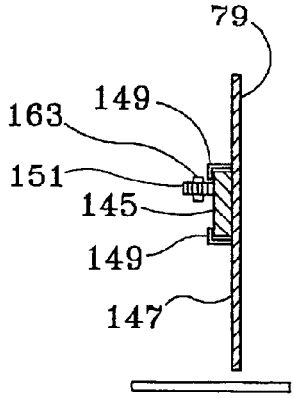
FIG. 16 is a side view of the locking bar shown in FIG. 15.

Secondly, as shown in FIGS. 15 and 16, a locking bar 145 is slidingly mounted on the outer surface 147 of deposit actuator front wall 79 cradled in a pair of spaced-apart support flanges 149. Movement of said bar 147 is limited from side to side on surface 145 by a peg 151 extending outward from surface 147 thru a slot 153 formed in bar 145. Bar 145 is further defined by a terminal end 159 that is located close to the inside surface 161 of upper deposit safe side wall 39.

After full assembly of safe 1, and the assembly of locking bar 145 on outer surface 147 of wall 79, lockable safe door 17 is opened and cabinet door 45 is closed. The installer reaches his or her hand inside hollow safe interior 15 and upward thru coincident openings 47 and 95 to grasp locking bar 145 which is by then in a slidable position between support flanges 149. The installer grasps locking bar 145 and slides it toward inside wall surface 157, that is the same wall next to which door hinge 53 is located so that it's terminal edge 159 comes into contact with side wall inside surface 157. A lock nut 163, threadably received on peg 151, is then tightened to hold bar 145 in fixed position on the rear wall surface 147. Should hinge pin 53 be severed by thieves, pulling door 45 out from the hinge pin side of opening 47 will be deterred because of the interference of bar 145 with inside door rim 139.

Figure 18:
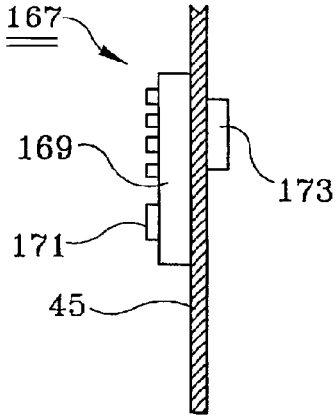
FIG. 18 is a side view of the cabinet door showing the electronic lock, the code input buttons, the digital readout and the computer processor incorporated therewith.

Locking means 167 on cabinet door 45 preferably comprises a push button-type electric lock 169 coupled to a digital readout 171 as shown in FIGS. 2 and 18. Lock 169 also preferably includes a computer processor 173 with an internal memory section to record, for play back, information concerning the code entered, the date, time, and duration of the opening of cabinet door 45. The function of lock 169 is that the memory is inputted with one or more access combination codes and the push buttons are actuated by the manager or owner to input the codes, and electronic processor 173 processes the codes and actuates the door lock when a recognizable code is inputted therein. Each manager is provided with his or her own special push-button code that is enterable into electric lock 169 to open cabinet door 45 for access to deposit plate 59. By this manner, each manger is identified when opening cabinet door 45. This information may be used to identify the person using safe 1 at certain times to reduce the area of inquiry should thievery take place.

Figure 17A:
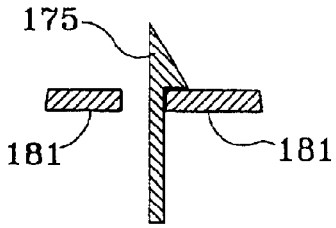
FIGS. 17*a*–17*c* are illustrative views of a locking bolt that locks the cabinet door closed (and locked) each time it is closed.
Figure 17B:
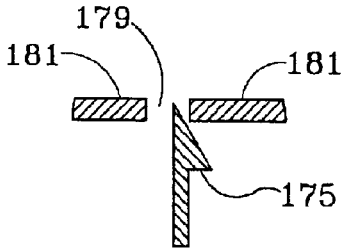
Figure 17C:
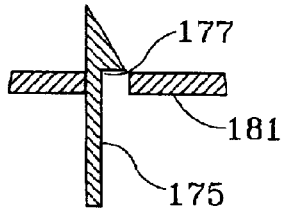

A locking bolt 175, attached to door 45, locks door 45 each time it is pushed closed. As shown in FIG. 17*a*–17*c*, locking bolt 175 possesses a catch or undercut 177 that passes through a slot 179 formed in a bar 181 to catch against said bar and hold door 45 closed (FIG. 17*a*). Upon entering the proper code, bolt 175 is moved sideways such that it does not catch bar 181 (FIG. 17*b*) thus allowing door 45 to be opened and bolt 175 to slip through slot 179. Each time door 45 is closed, bolt 175 passes through slot 179 (FIG. 17*c*) and moves sideways, this time in the opposite direction, to return to its position locked against bar 181 as shown in FIG. 17*a*.

Figure 19:
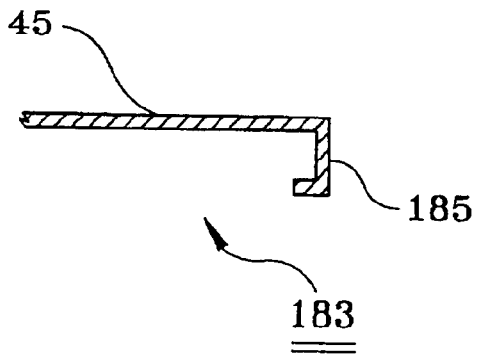
FIG. 19 is a side view of an outside handle for use on the cabinet lockable door.
Figure 20:
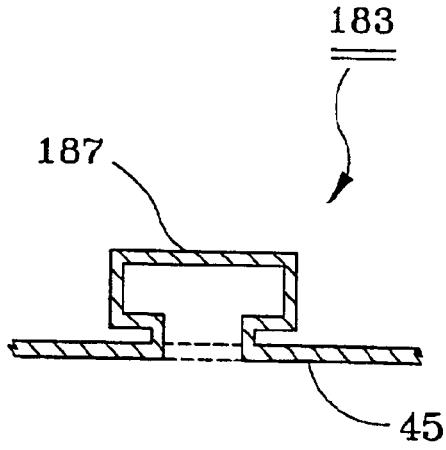
FIG. 20 is a side view of a detent-type handle for use on the cabinet lockable door.

Handling means 183, on first lockable door 17, may include an outwardly graspable handle 185, as shown in FIGS. 1 and 19, or inwardly graspable detent type handle 187 as shown in FIG. 2 and 20.

Figure 3:
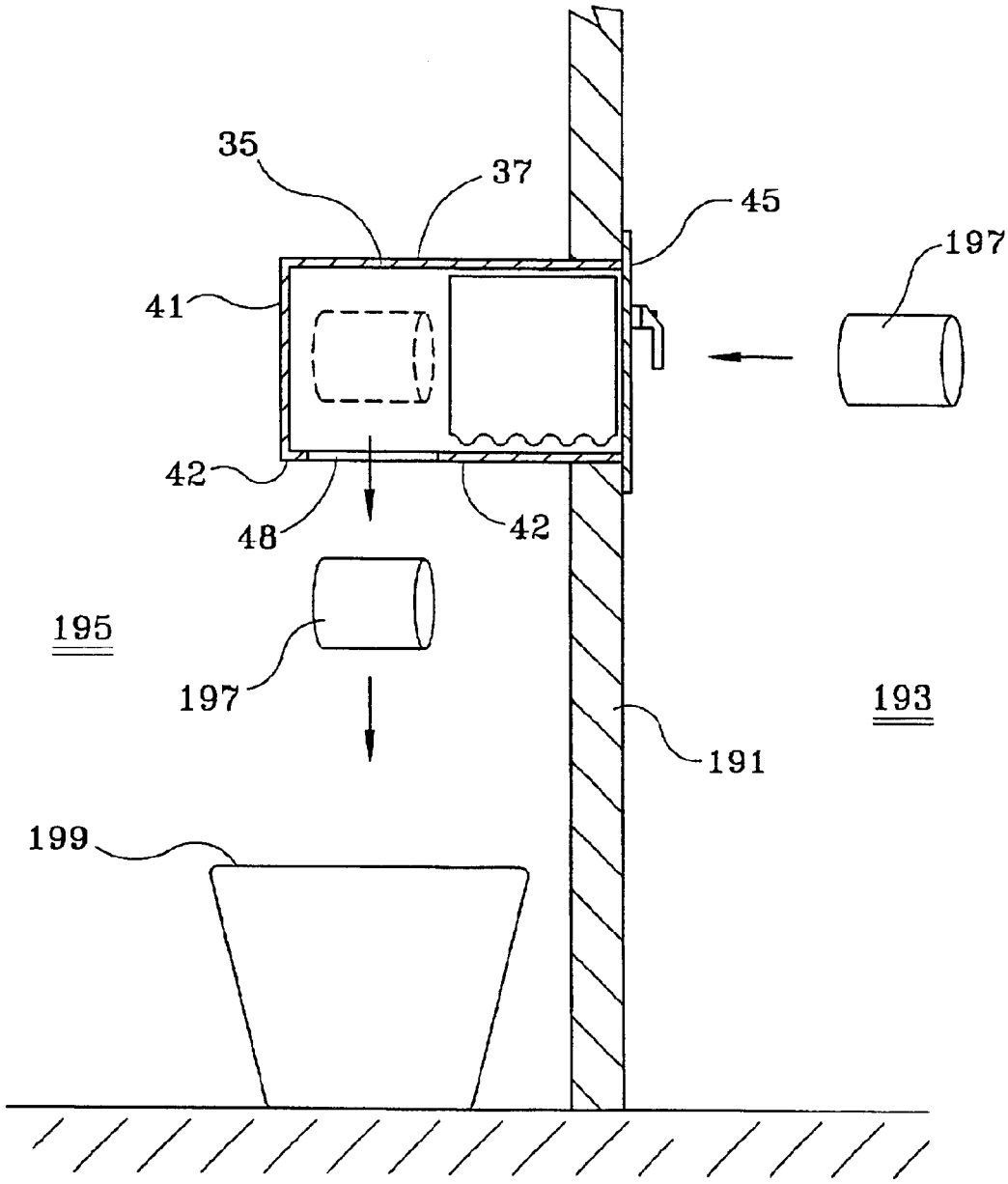
FIG. 3 is an illustrative view of another embodiment of this invention.

In FIG. 3 is shown another embodiment of the invention. In this invention, cabinet 35 is mounted in an opening formed in a wall 191. Wall 191 separates a room 193 from another, adjacent room 195. Cabinet top wall 37, side walls 39, rear wall 41 and bottom wall 42 extend into room 195 while cabinet door 45 opens into room 193. Cabinet bottom wall opening 48 is located in room 195. As shown, a deposit pouch 197 is inserted into cabinet 35 on deposit plate 59 and door 45 closed. Pouch is moved off plate 59 as previously described so that it falls by gravity through opening 48 to a receptacle 199 located below in room 195.

Figure 22:
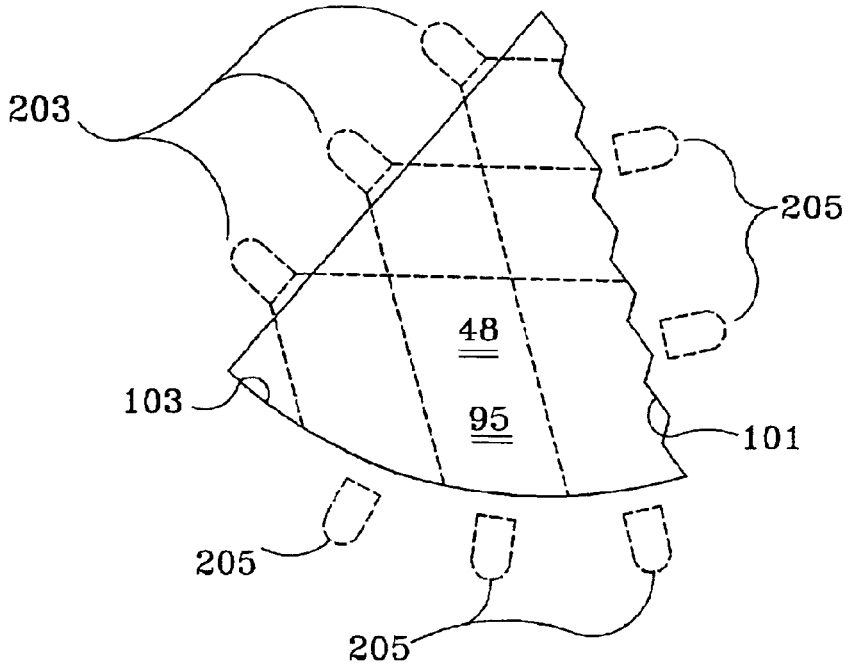
FIG. 22 is an illustrative view of the electric curtain formed by photoelectric cells and receptors across the opening in the bottom of the deposit cabinet for indicating when a deposit passes therethrough; and, FIG. 23 is a perspective view of a portion of the slot in the front wall of the deposit actuator showing the deposit plate passing therethrough during opening and closing of the cabinet door.
Figure 23:
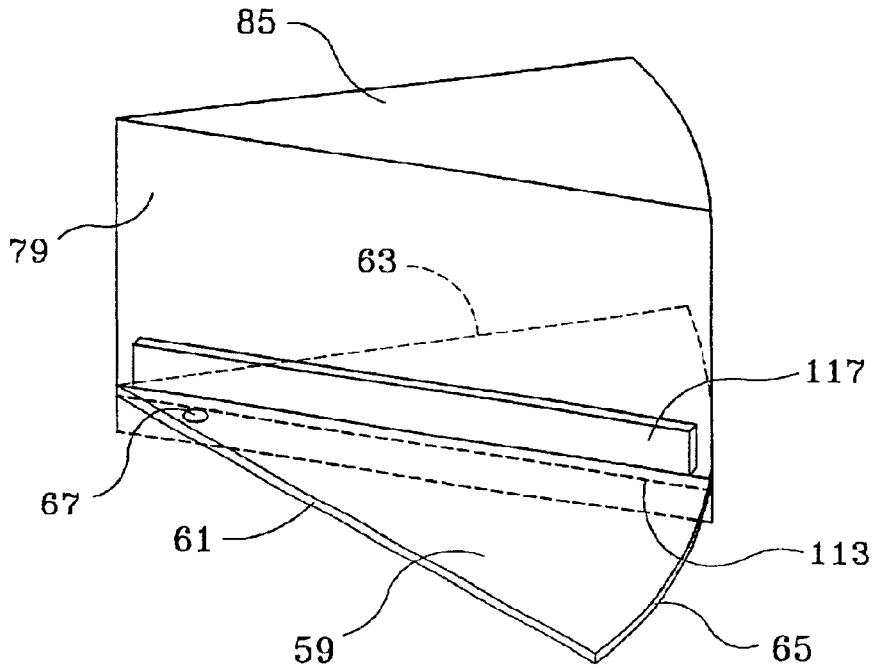

In FIG. 22 is shown another embodiment of the invention wherein a plurality of photoelectric cells 203 are arranged to shine across openings 48 and/or 95 into receptors 205 to provide an electronic curtain through which deposits pass as they drop from cabinet 35 downward through openings 48 and/or 95. Photoelectric cells 203 operate as a means for creating an electric curtain across the communications opening between safe 1 and cabinet 35 and receptors 205 operate to determine when the electric curtain has been penetrated by passage of an item, such as deposit pouch 197 has been dropped from cabinet interior 43 down into safe interior 15. This embodiment provides further evidence to the manager or store owner to determine when deposits have been made into cabinet 35.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A low profile depository cabinet-safe combination comprising:

a) a safe forming a hollow safe interior therein accessible through a lockable door;

b) a depository cabinet set atop and locked to said safe, forming an enclosed cabinet interior accessible through a horizontally, pivotally mounted lockable front door by inputting an unlocking combination therein;

c) an opening formed in said safe and an opening formed in said cabinet to place the respective interiors thereof in vertical communication with each other;

d) deposit handling means in said depository cabinet including:

i) a deposit plate moveable from inside said cabinet interior, with said cabinet door, to outside said cabinet when said cabinet door is fully opened, on which to place a deposit; and, ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior; and, e) means for preventing said cabinet door from being reopened until another unlocking combination is inputted to unlock said cabinet front door.

2. The low profile depository cabinet-safe combination of claim 1 wherein said lockable cabinet door includes an electric push-button-activated locking and unlocking mechanism that comprises a memory, to hold the accessible combination codes, a set of push buttons for inputting the codes, and an electronic processor to process the codes and actuate the door lock when a recognizable code is inputted therein.

3. The low profile depository cabinet-safe combination of claim 2 wherein said memory also includes a provision to record the date, time and access code of all entrances into said depository cabinet.

4. The low profile depository cabinet-safe combination of claim 1 further including anti-theft baffle means along the edges surrounding said openings formed in said depository cabinet and said safe to place their respective interiors in vertical communication with each other.

5. The low profile depository cabinet-safe combination of claim 1 wherein said deposit handling means further includes:

a) a deposit actuator front wall, a deposit actuator rear wall and a deposit actuator curved outside wall joined along their respective bordering edges to form a 3-dimensional pie-shaped figure no smaller than the size of said deposit plate, and a sleeve formed at the intersection of said front wall and said rear wall for pivotal mounting of said deposit actuator for moving with said cabinet door;

b) a slot formed in said deposit actuator front wall adapted to allow entrance of said deposit plate therein when said cabinet door is closed and to allow exit of said deposit plate therefrom when said cabinet door is opened; and, c) means for allowing said deposit actuator, with said deposit plate inside thereof, to rotate with said deposit actuator as said cabinet door is opened, until said deposit plate is fully outside said cabinet, and then to halt further pivotal movement of said deposit plate and allow said deposit actuator to continue to swing open with said cabinet door while holding said deposit actuator and allowing it to pass out through said slot in said deposit actuator front wall.

6. The low profile depository cabinet-safe combination of claim 1 wherein said deposit handling means further includes:

a) a deposit actuator front wall, a deposit actuator rear wall and a deposit actuator curved outside wall joined along their respective bordering edges to form a 3-dimensional pie-shaped figure of a size no smaller than the size of said deposit plate, and a sleeve formed at the intersection of said front wall and said rear wall for pivotal mounting of said deposit actuator for moving with said cabinet door;

b) a slot formed in said deposit actuator front wall adapted to allow entrance of said deposit plate therein when said cabinet door is closed and to allow exit of said deposit plate therefrom when said cabinet door is opened; and, c) means for allowing said deposit actuator, with said deposit plate outside thereof, to rotate apart from said deposit actuator as said cabinet door is closed, until said deposit plate is fully inside said cabinet, and then allow said deposit actuator to continue to rotate inward toward said cabinet interior with said cabinet door, to force said deposit plate in through said slot and begin to enter said deposit actuator and, simultaneously, push all deposits off said deposit plate and over said communication hole as said cabinet door is closing.

7. The low profile depository cabinet-safe combination of claim 5 wherein said deposit plate has a sinusoidal surface and said slot is formed with a similar sinusoidal opening to allow close passage over said surface.

8. The low profile depository cabinet-safe combination of claim 6 wherein said deposit plate has a sinusoidal surface and said slot is formed with a similar sinusoidal opening to allow close passage over said surface.

9. The low profile depository cabinet-safe combination of claim 1 wherein said safe door and said cabinet door are mounted on the same side of the cabinet-safe combination.

10. The low profile depository cabinet-safe combination of claim 1 wherein said safe door and said cabinet door are mounted on the same side of the cabinet-safe combination and both said doors are mounted to swing through a horizontal arc.

11. The low profile depository cabinet-safe combination of claim 1 further including a means for creating an electric curtain across said communications opening between said safe and said cabinet and receptors to determine when said curtain has been penetrated by passage of an item dropped from said cabinet interior down into said safe interior.

12. The low profile depository cabinet-safe combination of claim 5 further including means for deterring removal of said pivotally-mounted cabinet door, said means comprising:

a) a locking bar slidingly mounted on said deposit actuator front wall in a pair of spaced-apart support flanges, said locking bar of a length sufficient to be extended to and placed in contact with the inside surface of said cabinet side wall on the side thereof on which said door hinge is mounted; and, b) means for locking said locking bar against an inside cabinet wall so that said front door will jam when said hinges are severed and said cabinet is attempted to be removed by the severed hinge side first.

13. The low profile depository cabinet-safe combination of claim 1 further including an outside rim, formed on said cabinet door, that fits into an inset formed about the cabinet opening in which said cabinet door is pivotally mounted to discourage the practice of, slipping or inserting a "fish" wire in between the edges of said cabinet door and said cabinet opening in order to unlawfully penetrate said cabinet.

14. A depository cabinet comprising a top cabinet wall, a plurality of downwardly descending cabinet side walls terminated by a bottom wall forming an enclosed cabinet interior accessible through a pivotally mounted lockable front door formed over an opening in a contiguous front wall, said cabinet door openable by inputting an unlocking combination therein, said cabinet further comprising:

a) an opening formed in said cabinet bottom wall; and, b) deposit handling means in said depository cabinet including:

i) a horizontally positioned deposit plate moveable from inside said cabinet interior, with said cabinet door, to outside said cabinet, when said cabinet door is fully opened, on which to place a deposit; and, ii) a deposit actuator for moving with said cabinet door to move said deposit plate and the deposit placed thereupon from outside said cabinet into said cabinet interior, as said cabinet door is being closed, and off said deposit plate, over said opening, when said cabinet door is being fully closed, to allow the deposit to fall down through said bottom wall opening; and, e) means for preventing said cabinet door from being reopened until another unlocking combination is inputted to unlock said cabinet front door.

15. The low profile depository cabinet combination of claim 14 wherein said lockable cabinet door includes an electric push-button-activated locking and unlocking mechanism that comprises a memory, to hold the accessible combination codes, a set of push buttons for inputting the codes, and an electronic processor to process the codes and actuate a door lock when a recognizable code is inputted therein.

16. The low profile depository cabinet combination of claim 15 wherein said memory also includes a provision to record the date, time and access code of all entrances into said depository cabinet.

17. The low profile depository cabinet combination of claim 14 further including anti-theft baffle means along the edges surrounding said openings formed in said depository cabinet to place their respective interiors in vertical communication with each other.

18. The low profile depository cabinet combination of claim 14 wherein said deposit handling means further includes:

a) a deposit actuator front wall, a deposit actuator rear wall and a deposit actuator curved outside wall joined along their respective bordering edges to form a 3-dimensional pie-shaped figure no smaller than the size of said deposit plate, and a sleeve formed at the intersection of said front wall and said rear wall for pivotal mounting of said deposit actuator for moving with said cabinet door;

b) a slot formed in said deposit actuator front wall adapted to allow entrance of said deposit plate therein when said cabinet door is closed and to allow exit of said deposit plate therefrom when said cabinet door is opened; and, c) means for allowing said deposit actuator, with said deposit plate inside thereof, to rotate with said deposit actuator as said cabinet door is opened, until said deposit plate is fully outside said cabinet, and then to halt further pivotal movement of said deposit plate and allow said deposit actuator to continue to swing open with said cabinet door while holding said deposit actuator and allowing it to pass out through said slot in said deposit actuator front wall.

19. The low profile depository cabinet combination of claim 14 wherein said deposit handling means further includes:

a) a deposit actuator front wall, a deposit actuator rear wall and a deposit actuator curved outside wall joined along their respective bordering edges to form a 3-dimensional pie-shaped figure of a size no smaller than the size of said deposit plate, and a sleeve formed at the intersection of said front wall and said rear wall for pivotal mounting of said deposit actuator for moving with said cabinet door;

b) a slot formed in said deposit actuator front wall adapted to allow entrance of said deposit plate therein when said cabinet door is closed and to allow exit of said deposit plate therefrom when said cabinet door is opened; and, c) means for allowing said deposit actuator, with said deposit plate outside thereof, to rotate apart from said deposit actuator as said cabinet door is closed, until said deposit plate is fully inside said cabinet, and then allow said deposit actuator to continue to rotate inward toward said cabinet interior with said cabinet door, to force said deposit plate in through said slot and begin to enter said deposit actuator and, simultaneously, push all deposits off said deposit plate and over said communication hole as said cabinet door is closing.

20. The low profile depository cabinet-safe combination of claim 19 wherein said deposit plate has a sinusoidal surface and said slot is formed with a similar sinusoidal opening to allow close passage over said surface.

21. The low profile depository cabinet-safe combination of claim 20 wherein said deposit plate has a sinusoidal surface and said slot is formed with a similar sinusoidal opening to allow close passage over said surface.

22. The low profile depository cabinet combination of claim 14 further including means for creating an electric curtain across said cabinet bottom wall opening to determine when said curtain has been penetrated by passage of an item dropped from said cabinet interior.

23. The low profile depository cabinet-safe combination of claim 18 further including means for deterring removal of said pivotally-mounted cabinet door said means comprising:

a) a locking bar slidingly mounted on said deposit actuator front wall in a pair of spaced-apart support flanges, said locking bar of a length sufficient to be extended to and placed in contact with the inside surface of said cabinet side wall on the side thereof on which said door hinge is mounted; and, b) means for locking said locking bar against an inside cabinet wall so that said cabinet door will jam when said hinges are severed and said cabinet is attempted to be removed by the severed hinge side first.

24. The low profile depository cabinet-safe combination of claim 14 further including an outside rim, formed on said cabinet door, that fits into an inset formed about the cabinet opening in which said cabinet door is pivotally mounted to discourage the practice of slipping or inserting a "fish" wire in between the edges of said cabinet door and said cabinet opening in order to unlawfully penetrate said cabinet.

25. A low profile depository cabinet-safe combination comprising:

a) a safe forming a hollow safe interior therein accessible through a lockable door;

b) a depository cabinet set atop and locked to said safe, forming an enclosed cabinet interior accessible through a pivotally mounted lockable front door by inputting an unlocking combination therein;

c) an opening formed in said safe and an opening formed in said cabinet to place the respective interiors thereof in vertical communication with each other;

d) deposit handling means in said depository cabinet including:

i) a deposit plate moveable from inside said cabinet interior, with said cabinet door, to outside said cabinet when said cabinet door is fully opened, on which to place a deposit;

ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior;

iii) a deposit actuator front wall, a deposit actuator rear wall and a deposit actuator curved outside wall joined along their respective bordering edges to form a 3-dimensional pie-shaped figure no smaller than the size of said deposit plate, and a sleeve formed at the intersection of said front wall and said rear wall for pivotal mounting of said deposit actuator for moving with said cabinet door;

iv) a slot formed in said deposit actuator front wall adapted to allow entrance of said deposit plate therein when said cabinet door is closed and to allow exit of said deposit plate therefrom when said cabinet door is opened; and v) means for allowing said deposit actuator, with said deposit plate inside thereof, to rotate with said deposit actuator as said cabinet door is opened, until said deposit plate is fully outside said cabinet, and then to halt further pivotal movement of said deposit plate and allow said deposit actuator to continue to swing open with said cabinet door while holding said deposit actuator and allowing it to pass out through said slot in said deposit actuator front wall.

e) means for preventing said cabinet door from being reopened until another unlocking combination is inputted to unlock said cabinet front door.

26. A low profile depository cabinet-safe combination comprising:

a) a safe forming a hollow safe interior therein accessible through a lockable door;

b) a depository cabinet set atop and locked to said safe, forming an enclosed cabinet interior accessible through a pivotally mounted lockable front door by inputting an unlocking combination therein;

c) an opening formed in said safe and an opening formed in said cabinet to place the respective interiors thereof in vertical communication with each other;

d) deposit handling means in said depository cabinet including:

i) a deposit plate moveable from inside said cabinet interior, with said cabinet door, to outside said cabinet when said cabinet door is fully opened, on which to place a deposit;

ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior;

iii) a deposit actuator front wall, a deposit actuator rear wall and a deposit actuator curved outside wall joined along their respective bordering edges to form a 3-dimensional pie-shaped figure of a size no smaller than the size of said deposit plate, and a sleeve formed at the intersection of said front wall and said rear wall for pivotal mounting of said deposit actuator for moving with said cabinet door;

iv) a slot formed in said deposit actuator front wall adapted to allow entrance of said deposit plate therein when said cabinet door is closed and to allow exit of said deposit plate therefrom when said cabinet door is opened; and, v) means for allowing said deposit actuator, with said deposit plate outside thereof, to rotate apart from said deposit actuator as said cabinet door is closed, until said deposit plate is fully inside said cabinet, and then allow said deposit actuator to continue to rotate inward toward said cabinet interior with said cabinet door, to force said deposit plate in through said slot and begin to enter said deposit actuator and, simultaneously, push all deposits off said deposit plate and over said communication hole as said cabinet door is closing; and e) means for preventing said cabinet door from being reopened until another unlocking combination is inputted to unlock said cabinet front door.

27. A low profile depository cabinet-safe combination comprising:

a) a safe forming a hollow safe interior therein accessible through a lockable door;

b) a depository cabinet set atop and locked to said safe, forming an enclosed cabinet interior accessible through a pivotally mounted lockable front door by inputting an unlocking combination therein;

c) an opening formed in said safe and an opening formed in said cabinet to place the respective interiors thereof in vertical communication with each other;

d) deposit handling means in said depository cabinet including:

i) a deposit plate moveable from inside said cabinet interior, with said cabinet door, to outside said cabinet when said cabinet door is fully opened, on which to place a deposit;

ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior;

iii) a deposit actuator front wall, a deposit actuator rear wall and a deposit actuator curved outside wall joined along their respective bordering edges to form a 3-dimensional pie-shaped figure no smaller than the size of said deposit plate, and a sleeve formed at the intersection of said front wall and said rear wall for pivotal mounting of said deposit actuator for moving with said cabinet door;

iv) a slot formed in said deposit actuator front wall adapted to allow entrance of said deposit plate therein when said cabinet door is closed and to allow exit of said deposit plate therefrom when said cabinet door is opened; and v) means for allowing said deposit actuator, with said deposit plate inside thereof, to rotate with said deposit actuator as said cabinet door is opened, until said deposit plate is fully outside said cabinet, and then to halt further pivotal movement of said deposit plate and allow said deposit actuator to continue to swing open with said cabinet door while holding said deposit actuator and allowing it to pass out through said slot in said deposit actuator front wall; and e) means for preventing said cabinet door from being reopened until another unlocking combination is inputted to unlock said cabinet front door.

28. A low profile depository cabinet-safe combination comprising:

a) a safe forming a hollow safe interior therein accessible through a lockable door;

b) a depository cabinet set atop and locked to said safe, forming an enclosed cabinet interior accessible through a pivotally mounted lockable front door by inputting an unlocking combination therein;

c) an opening formed in said safe and an opening formed in said cabinet to place the respective interiors thereof in vertical communication with each other;

d) deposit handling means in said depository cabinet including:

i) a deposit plate moveable from inside said cabinet interior, with said cabinet door, to outside said cabinet when said cabinet door is fully opened, on which to place a deposit and further wherein said deposit plate has a sinusoidal surface and said slot is formed with a similar sinusoidal opening to allow close passage over said surface;

ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior;

iii) a deposit actuator front wall, a deposit actuator rear wall and a deposit actuator curved outside wall joined along their respective bordering edges to form a 3-dimensional pie-shaped figure of a size no smaller than the size of said deposit plate, and a sleeve formed at the intersection of said front wall and said rear wall for pivotal mounting of said deposit actuator for moving with said cabinet door;

iv) a slot formed in said deposit actuator front wall adapted to allow entrance of said deposit plate therein when said cabinet door is closed and to allow exit of said deposit plate therefrom when said cabinet door is opened; and, v) means for allowing said deposit actuator, with said deposit plate outside thereof, to rotate apart from said deposit actuator as said cabinet door is closed, until said deposit plate is fully inside said cabinet, and then allow said deposit actuator to continue to rotate inward toward said cabinet interior with said cabinet door, to force said deposit plate in through said slot and begin to enter said deposit actuator and, simultaneously, push all deposits off said deposit plate and over said communication hole as said cabinet door is closing; and e) means for preventing said cabinet door from being reopened until another unlocking combination is inputted to unlock said cabinet front door.

29. A low profile depository cabinet-safe combination comprising:

a) a safe forming a hollow safe interior therein accessible through a lockable door;

b) a depository cabinet set atop and locked to said safe, forming an enclosed cabinet interior accessible through a pivotally mounted lockable front door by inputting an unlocking combination therein;

c) an opening formed in said safe and an opening formed in said cabinet to place the respective interiors thereof in vertical communication with each other wherein said safe door and said cabinet door are mounted on the same side of the combination and both said cabinet doors are mounted to swing through a horizontal arc;

d) deposit handling means in said depository cabinet including:

i) a deposit plate moveable from inside said cabinet interior, with said cabinet door, to outside said cabinet when said cabinet door is fully opened, on which to place a deposit; and, ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior; and, e) means for preventing said cabinet door from being reopened until another unlocking combination is inputted to unlock said cabinet front door.

30. A low profile depository cabinet-safe combination comprising:

a) a safe forming a hollow safe interior therein accessible through a lockable front door;

b) a depository cabinet set atop and locked to said safe, forming an enclosed cabinet interior accessible through a pivotally mounted lockable front door by inputting an unlocking combination therein;

c) an opening formed in said safe and an opening formed in said cabinet to place the respective interiors thereof in vertical communication with each other;

d) deposit handling means in said depository cabinet including:

i) a deposit plate moveable from inside said cabinet interior, with said cabinet door, to outside said cabinet when said cabinet door is fully opened, on which to place a deposit; and, ii) a deposit actuator for moving with said cabinet door to move said deposit plate and the deposit placed upon it from outside said cabinet into said cabinet interior, as said cabinet door is being closed, and off said deposit plate, over said communications opening, to allow the deposit to fall down into said safe interior;

e) means for preventing said cabinet door from being reopened until another unlocking combination is inputted to unlock said cabinet front door;

f) a locking bar slidingly mounted on a deposit actuator front wall in a pair of spaced-apart support flanges, said locking bar of a length sufficient to be extended to and placed in contact with the inside surface of said cabinet side wall on the side thereof on which said cabinet door hinge is mounted; and g) means for locking said locking bar against an inside cabinet wall so that said cabinet door will jam when said hinges are severed and said cabinet is attempted to be removed by the severed hinge side first.

31. A depository cabinet comprising a top cabinet wall, a plurality of downwardly descending cabinet side walls terminated by a bottom wall forming an enclosed cabinet interior accessible through a pivotally mounted lockable front door formed over an opening in a contiguous front wall, said cabinet door openable by inputting an unlocking combination therein, said cabinet further comprising:

a) an opening formed in said cabinet bottom wall; and, b) deposit handling means in said depository cabinet including:

i) a deposit plate moveable from inside said cabinet interior, with said cabinet door, to outside said cabinet, when said cabinet door is fully opened, on which to place a deposit;

ii) a deposit actuator for moving with said cabinet door to move said deposit plate and the deposit placed thereupon from outside said cabinet into said cabinet interior, as said cabinet door is being closed, and off said deposit plate, over said opening, when said cabinet door is being fully closed, to allow the deposit to fall down through said bottom wall opening;

iii) a deposit actuator front wall, a deposit actuator rear wall and a deposit actuator curved outside wall joined along their respective bordering edges to form a 3-dimensional pie-shaped figure no smaller than the size of said deposit plate, and a sleeve formed at the intersection of said front wall and said rear wall for pivotal mounting of said deposit actuator for moving with said cabinet door;

iv) a slot formed in said deposit actuator front wall adapted to allow entrance of said deposit plate therein when said cabinet door is closed and to allow exit of said deposit plate therefrom when said cabinet door is opened; and, v) means for allowing said deposit actuator, with said deposit plate inside thereof, to rotate with said deposit actuator as said cabinet door is opened, until said deposit plate is fully outside said cabinet, and then to halt further pivotal movement of said deposit plate and allow said deposit actuator to continue to swing open with said cabinet door while holding said deposit actuator and allowing it to pass out through said slot in said deposit actuator front wall; and e) means for preventing said cabinet door from being reopened until another unlocking combination is inputted to unlock said cabinet front door.

32. A depository cabinet comprising a top cabinet wall, a plurality of downwardly descending cabinet side walls terminated by a bottom wall forming an enclosed cabinet interior accessible through a pivotally mounted lockable front door formed over an opening in a contiguous front wall, said cabinet door openable by inputting an unlocking combination therein, said cabinet further comprising:

a) an opening formed in said cabinet bottom wall; and, b) deposit handling means in said depository cabinet including:

i) a deposit plate moveable from inside said cabinet interior, with said cabinet door, to outside said cabinet, when said cabinet door is fully opened, on which to place a deposit; and, ii) a deposit actuator for moving with said cabinet door to move said deposit plate and the deposit placed thereupon from outside said cabinet into said cabinet interior, as said cabinet door is being closed, and off said deposit plate, over said opening, when said cabinet door is being fully closed, to allow the deposit to fall down through said opening;

iii) a deposit actuator front wall, a deposit actuator rear wall and a deposit actuator curved outside wall joined along their respective bordering edges to form a 3-dimensional pie-shaped figure of a size no smaller than the size of said deposit plate, and a sleeve formed at the intersection of said front wall and said rear wall for pivotal mounting of said deposit actuator for moving with said cabinet door;

iv) a slot formed in said deposit actuator front wall adapted to allow entrance of said deposit plate therein when said cabinet door is closed and to allow exit of said deposit plate therefrom when said cabinet door is opened;

v) means for allowing said deposit actuator, with said deposit plate outside thereof, to rotate apart from said deposit actuator as said cabinet door is closed, until said deposit plate is fully inside said cabinet, and then allow said deposit actuator to continue to rotate inward toward said cabinet interior with said cabinet door, to force said deposit plate in through said slot and begin to enter said deposit actuator and, simultaneously, push all deposits off said deposit plate and over said communication hole as said cabinet door is closing; and e) means for preventing said cabinet door from being reopened until another unlocking combination is inputted to unlock said cabinet front door.

33. A depository cabinet comprising a top cabinet wall, a plurality of downwardly descending cabinet side walls terminated by a bottom wall forming an enclosed cabinet interior accessible through a pivotally mounted lockable front door formed over an opening in a contiguous front wall, said cabinet door openable by inputting an unlocking combination therein, said cabinet further comprising:

a) an opening formed in said cabinet bottom wall; and, b) deposit handling means in said depository cabinet including:

i) a deposit plate moveable from inside said cabinet interior, with said cabinet door, to outside said cabinet, when said cabinet door is fully opened, on which to place a deposit; and, ii) a deposit actuator for moving with said cabinet door to move said deposit plate and the deposit placed thereupon from outside said cabinet into said cabinet interior, as said cabinet door is being closed, and off said deposit plate, over said opening, when said cabinet door is being fully closed, to allow the deposit to fall down through said bottom wall opening wherein said deposit plate has a sinusoidal surface and said slot is formed with a similar sinusoidal opening to allow close passage over said surface; and, e) means for preventing said cabinet door from being reopened until another unlocking combination is inputted to unlock said cabinet front door.

34. A depository cabinet comprising a top cabinet wall, a plurality of downwardly descending cabinet side walls terminated by a bottom wall forming an enclosed cabinet interior accessible through a pivotally mounted lockable front door formed over an opening in a contiguous front wall, said cabinet door openable by inputting an unlocking combination therein, said cabinet further comprising:

a) an opening formed in said cabinet bottom wall; and, b) deposit handling means in said depository cabinet including:

i) a deposit plate moveable from inside said cabinet interior, with said cabinet door, to outside said cabinet, when said cabinet door is fully opened, on which to place a deposit;

ii) a deposit actuator for moving with said cabinet door to move said deposit plate and the deposit placed thereupon from outside said cabinet into said cabinet interior, as said cabinet door is being closed, and off said deposit plate, over said opening, when said cabinet door is being fully closed, to allow the deposit to fall down through said bottom wall opening wherein said deposit plate has a sinusoidal surface and said slot is formed with a similar sinusoidal opening to allow close passage over said surface; and, e) means for preventing said cabinet door from being reopened until another unlocking combination is inputted to unlock said cabinet front door.

35. A depository cabinet comprising a top cabinet wall, a plurality of downwardly descending cabinet side walls terminated by a bottom wall forming an enclosed cabinet interior accessible through a pivotally mounted lockable front door formed over an opening in a contiguous front wall, said cabinet door openable by inputting an unlocking combination therein, said cabinet further comprising:

a) an opening formed in said cabinet bottom wall; and, b) deposit handling means in said depository cabinet including:

i) a deposit plate moveable from inside said cabinet interior, with said cabinet door, to outside said cabinet, when said cabinet door is fully opened, on which to place a deposit; and, ii) a deposit actuator for moving with said cabinet door to move said deposit plate and the deposit placed thereupon from outside said cabinet into said cabinet interior, as said cabinet door is being closed, and off said deposit plate, over said opening, when said cabinet door is being fully closed, to allow the deposit to fall down through said bottom wall opening; and, e) means for preventing said cabinet door from being reopened until another unlocking combination is inputted to unlock said cabinet front door; and, f) a means for determining removal of said pivotally-mounted cabinet doors including i) a locking bar slidingly mounted on said deposit actuator front wall in a pair of spaced-apart support flanges, said locking bar of a length sufficient to be extended to and placed in contact with the inside surface of said cabinet side wall on the side thereof on which said cabinet door hinge is mounted; and, ii) means for locking said locking bar against an inside cabinet wall so that said cabinet door will jam when said hinges are severed and said cabinet is attempted to be removed by the severed hinge side first.

* * * * *